US007160051B1

(12) United States Patent
Cuny et al.

(10) Patent No.: US 7,160,051 B1
(45) Date of Patent: Jan. 9, 2007

(54) CLOSURE DEVICE

(75) Inventors: Arnaud Cuny, Domgermain (FR); Francis Berthon, Pompey (FR)

(73) Assignee: Saint-Gobain Pam, Nancy (FR)

( * ) Notice: Subject to any disclaimer, the term of this patent is extended or adjusted under 35 U.S.C. 154(b) by 0 days.

(21) Appl. No.: 11/277,805

(22) Filed: Mar. 29, 2006

(30) Foreign Application Priority Data

Feb. 28, 2006 (FR) ..... 06 01799

(51) Int. Cl.
*E02D 29/14* (2006.01)

(52) U.S. Cl. ..... 404/25

(58) Field of Classification Search ..... 404/25; 49/33, 504; 52/19; 220/3.8, 834, 810, 833
See application file for complete search history.

(56) References Cited

U.S. PATENT DOCUMENTS 1,923,481 A * 8/1933 Ford ..... 220/484
3,744,670 A * 7/1973 De Frees ..... 220/314
4,114,236 A * 9/1978 Vandervort ..... 16/335
5,366,317 A * 11/1994 Solimar ..... 404/25
6,446,307 B1 * 9/2002 Wilkins ..... 16/325
7,033,489 B1 * 4/2006 Thompson et al. ..... 210/164

FOREIGN PATENT DOCUMENTS

EP 0 506 590 * 3/1992
EP 0 533 533 * 9/1992

* cited by examiner

*Primary Examiner*—Gary S. Hartmann
(74) *Attorney, Agent, or Firm*—Sughrue Mion, PLLC

(57) ABSTRACT

A fixed frame (4) and a covering element (6), the frame (4) defining a frame plane (P—P). A first latch (30) has two latch surfaces (32, 34) which cooperate and which are inclined relative to the frame plane (P—P). The covering element (6) and the frame (4) comprise cooperating stop surfaces (52, 56) which limit a displacement of the lid (6) within the frame (4) in the frame plane (P—P). The stop surfaces (52, 56) are inclined relative to the frame plane (P—P) by an angle of from 30° to 80° and they maintain the covering element flat on the frame. Application to manhole covers for closing manholes.

16 Claims, 4 Drawing Sheets

CLOSURE DEVICE

TECHNICAL FIELD

The present invention relates to a closure device, especially a manhole cover, of the type comprising a fixed frame and a covering element supported by the frame, the frame defining a frame plane and a central axis, the covering element being articulated to the frame by a hinge, the device comprising a first latch provided with a first latch surface which is fixedly joined to the lid and with a first latch surface which is fixedly joined to the frame, these two first latch surfaces being inclined relative to the frame plane and cooperating when the covering element is in the closed position on the frame, the covering element and the frame having a stop which is offset circumferentially from the first latch relative to the central axis, the stop comprising a stop surface which is fixedly joined to the covering element and a stop surface which is fixedly joined to the frame, these stop surfaces cooperating exclusively when the covering element is in the closed position and limiting a displacement of the covering element within the frame in the frame plane.

BACKGROUND TO THE INVENTION

The invention is applicable especially to devices for closing manholes or inspection holes of an underground water network, such as manhole covers in roads or sidewalks, to devices for closing technical inspection chambers of an underground cable network, such as trap doors, and to gully grating devices, such as water-absorption grates.

The document EP-A-533 533 discloses a manhole cover having a latchable lid which comprises a hinge connecting the lid and the frame. The lid and the frame also comprise a resiliently engaging latch. The latch is provided with an end catch which is to cooperate with a corresponding clip-in stop of the frame, the catch and its associated stop each comprising two inclined surfaces forming a cam which is active in the opening and closing direction of the lid.

The known manhole cover also comprises means for absorbing horizontal forces in the form of two stops 22 which project horizontally from the centre of the lid and which are to limit the displacement of the lid in the frame exclusively in the horizontal direction.

The object of the invention is to improve the mentioned manhole cover and to propose a closure device which, when the covering element is latched on its support frame, optimizes, with simple means, the stability of the covering element in the horizontal and vertical direction, it being possible for the covering element to be a lid or a grate.

SUMMARY OF THE INVENTION

To that end, the invention relates to a device of the type indicated, characterized in that the stop surfaces of the covering element and the frame are inclined relative to the frame plane by an angle of from 30° to 80° and they maintain the covering element flat on the frame.

According to particular embodiments, the closure device may comprise one or more of the following features:

the device comprises a second latch provided with a second latch surface which is fixedly joined to the covering element and with a second latch surface which is fixedly joined to the frame, these two second latch surfaces being inclined relative to the frame plane and cooperating when the covering element is in the closed position on the frame, the first latch being offset circumferentially from the second latch and the stop relative to the central axis;

the or each latch is offset circumferentially from the stop relative to the central axis by at least 90°;

the or each latch comprises a resilient member provided with one of the latch surfaces, and the resilient member enables the associated latch surface to be displaced between positions of latching the covering element in the frame and unlatching the covering element;

the or each resilient member urges, when the covering element is in the closed position, the or each latch surface of the covering element against the or each corresponding latch surface of the frame and the stop surface of the covering element against the corresponding stop surface of the frame;

the or each resilient member is a circumferential resilient arm, the associated latch surface being located on a free end of that arm, the other end of that arm being secured to the covering element;

the resilient arms extend in opposite circumferential directions;

the closure device comprises means for limiting the displacement of the latch surface located on the resilient member, this being effected in the direction of displacement towards the position of unlatching the covering element;

the hinge comprises a frame knuckle and a covering element knuckle, and the stop is formed by at least one projection which is fixedly joined to the knuckle of the covering element and a cooperating surface fixedly joined to the frame knuckle; and the closure device is a manhole cover.

BRIEF DESCRIPTION OF DRAWINGS

The invention will be better understood on reading the following description which is given purely by way of example and with reference to the appended drawings in which.

DESCRIPTION OF PREFERRED EMBODIMENT

The invention will be explained hereinafter with reference to a manhole cover. In general, it is applicable to any closure device provided with a frame and a lid or a grate forming a covering element.

Figure 3:
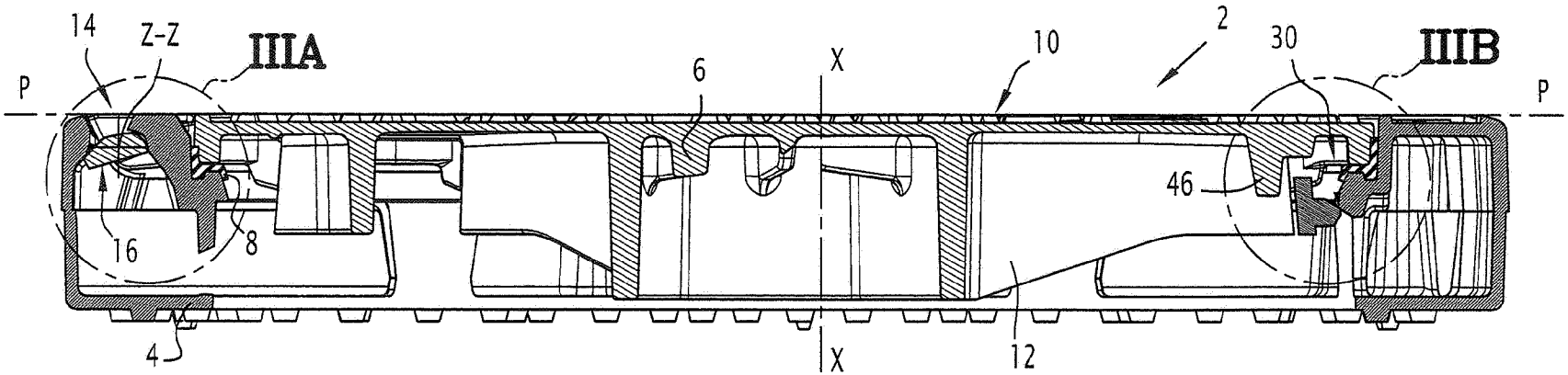
FIG. 3 is a sectioned view, taken on the plane III—III of FIGS. 1 and 2, of the manhole cover when the lid is in the closed position on the frame.

FIG. 3 shows a manhole cover according to the invention indicated by the general reference 2.

The manhole cover 2 comprises a fixed frame 4 and a closable lid 6. The manhole cover 2 is also provided with a sound-proofing lining 8 in the form of a ring produced from plastics material.

Figure 1:
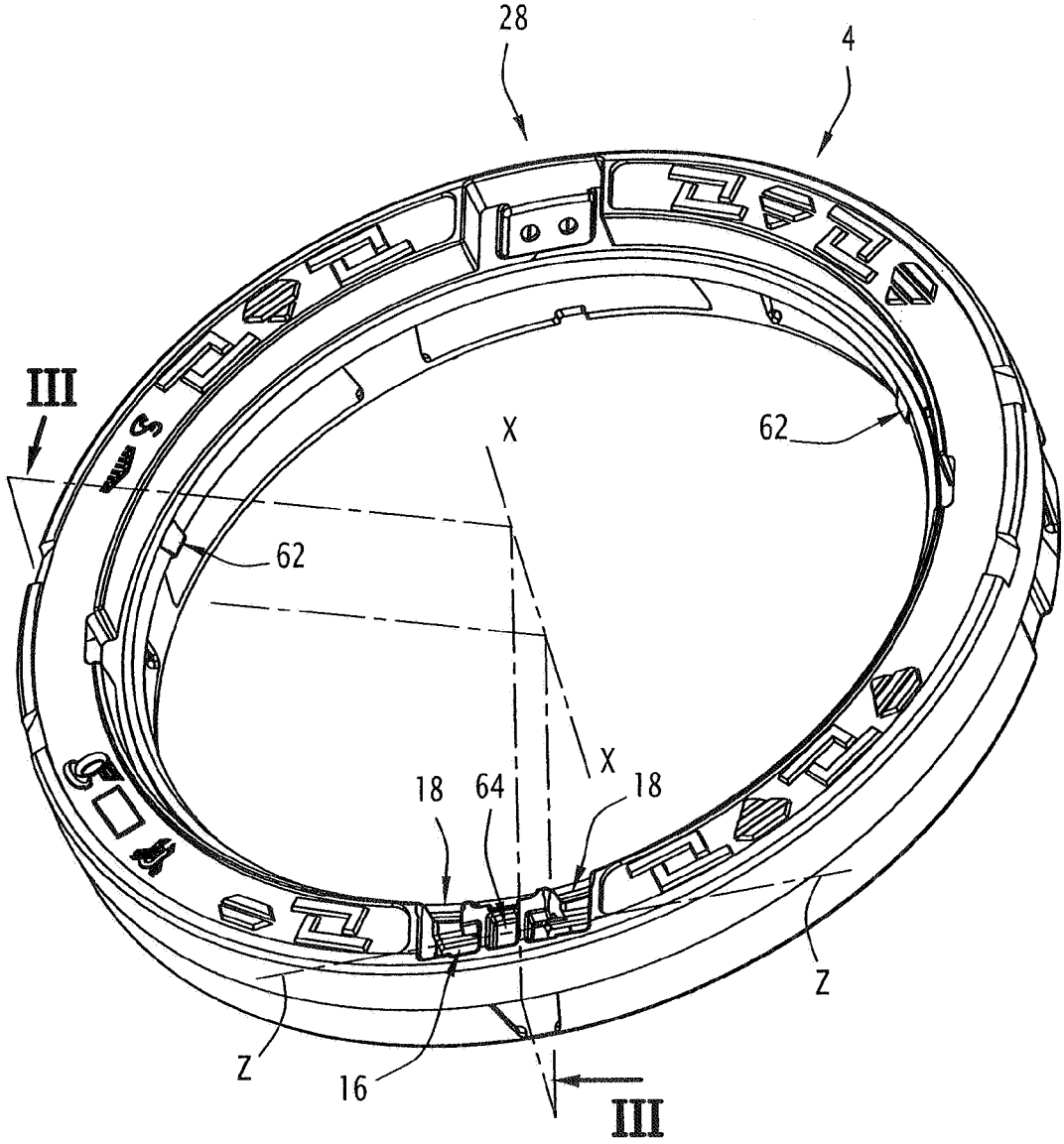
FIG. 1 is a perspective view of a frame of a manhole cover according to the invention.

The fixed frame 4 is a casting of ductile cast iron. As can be seen in FIG. 1, it has the general shape of a ring having a central axis X—X. It defines a frame plane P—P.

When the cover is in the mounted state, the central axis X—X extends vertically and the frame plane P—P extends horizontally and is flush with the surface of the road.

Unless otherwise indicated, the terms "circumferentially" and "radially" will be used hereinafter in relation to the central axis X—X.

Figure 2:
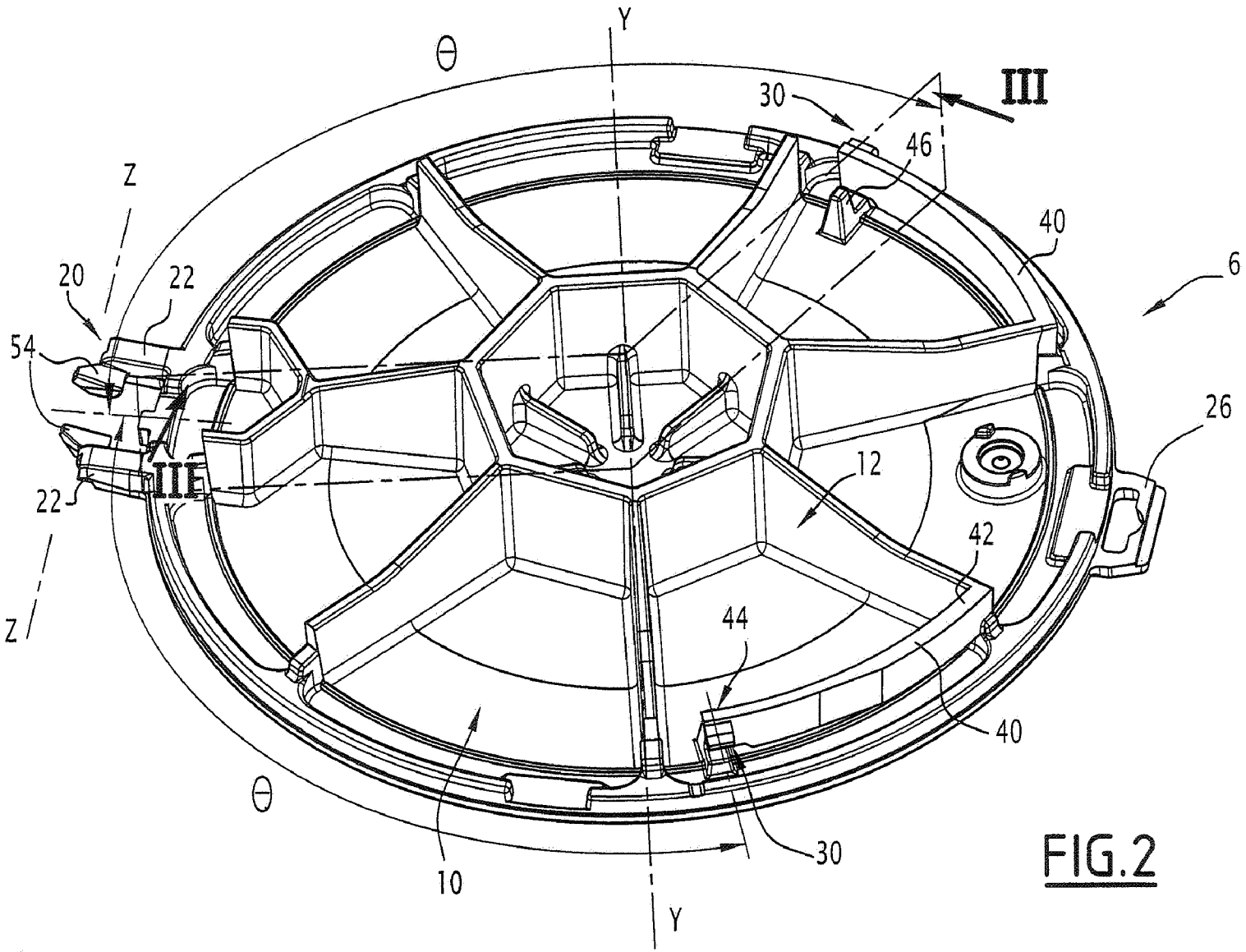
FIG. 2 is a bottom perspective view of a lid of a manhole cover according to the invention.

The lid 6, which is illustrated in FIG. 2, is cast in one piece in ductile cast iron and basically comprises a flat upper centre 10 beneath which stiffening ribs 12 project. The centre 10 has a circular shape with an axis Y—Y which, when the lid is in the closed position, coincides with the central axis X—X.

Figure 4:
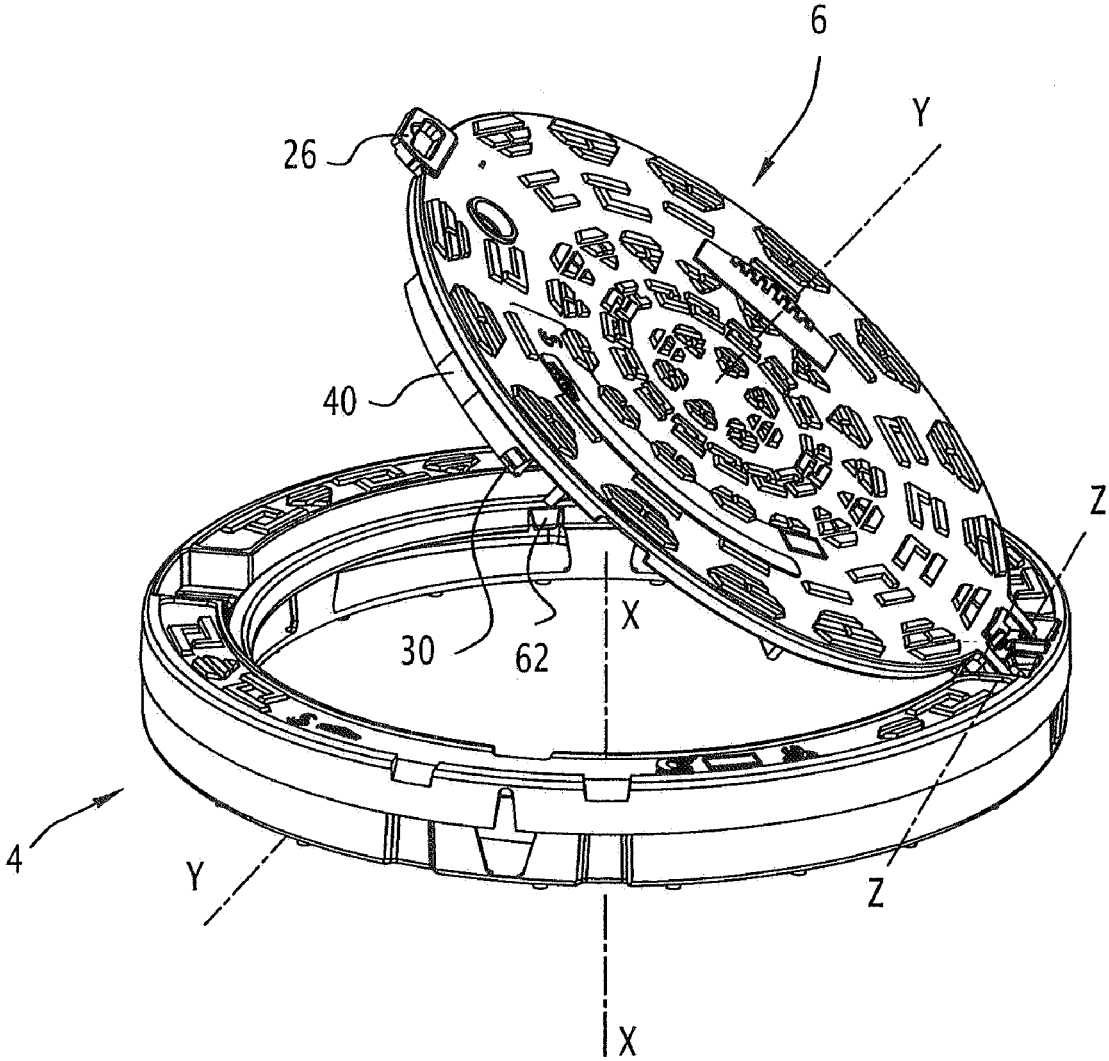
FIG. 4 is a perspective view showing the lid of FIG. 3 in a partially open position.

The lid 6 is articulated to the fixed frame 4 by a hinge 14 enabling the lid to rotate between an open position (FIG. 4) and a closed position (FIG. 3) about a hinge axis Z—Z as shown in FIGS. 3 and 4. The hinge 14 is provided with a frame knuckle 16 comprising two recesses 18 which are open towards the top in the mounted state, and with a lid knuckle 20 comprising two articulation lugs 22 extending substantially radially relative to the central axis Y—Y of the lid. The recesses 18 and the lugs 22 have cooperating hinge surfaces in the form of a segment of a cylinder having a circular cross-section with an axis Z—Z.

The lid 6 also has, opposite the hinge 14, an operating member 26 (FIGS. 2 and 4) for unlatching and opening the lid 6. When the lid 6 is in the closed position, this operating member 26 is received in a recess 28 of the frame located opposite the hinge 14.

The manhole cover 2 is also provided with two latches 30, one of which can be seen in FIG. 3. Each latch 30 comprises a latch surface 32 which is fixedly joined to the fixed frame 4 and a latch surface 34 which is fixedly joined to the lid 6. These latch surfaces 32, 34 are directed towards each other and inclined relative to the frame plane P—P by an angle $\alpha$ which ranges strictly from 0° to 60° and which is preferably from 30° to 45°.

As can be seen especially clearly in FIGS. 1, 2 and 4, each latch 30 is offset circumferentially from the hinge 14 by an angle $\theta$ which is at least 90°. In the case in point, the angle $\theta$ is substantially 120°, the latches 30 thus being offset circumferentially from each other by an angle of 120°.

Figure 3C:
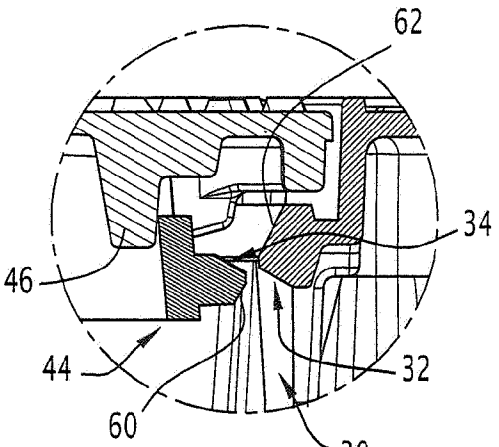
FIG. 3C shows the detail IIIB in the unlatched state of the lid.
Figure 3B:
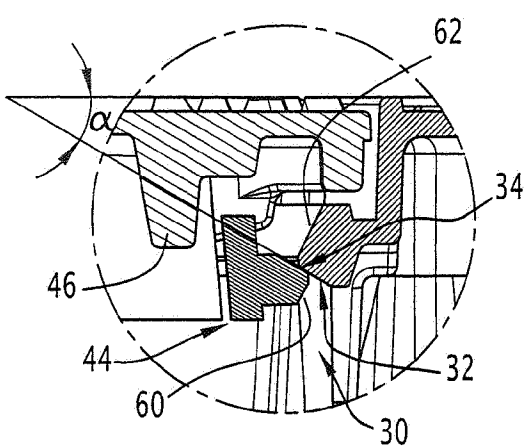
FIGS. 3A and 3B are enlarged details IIIA–IIIB of FIG. 3.
Figure 3A:
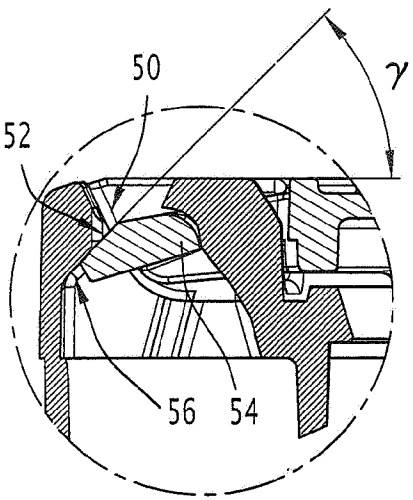

Each latch 30 comprises a circumferential resilient arm 40 which is resiliently deformable owing to the mechanical properties of the ductile cast iron of which it is composed. The resilient arm 40 has a fixed circumferential end 42 which is fixedly joined to one of the stiffening ribs 12 of the lid, while its other end 44 is free and carries the latch surface 34. By resilient deformation of the arm 40, the free end 44 is radially mobile between a position of latching the lid 6 in the frame 4, shown in FIGS. 3 and 3B, and a position of unlatching the lid 6 from the frame 4, shown in FIG. 3C. It can be seen that, in the unlatched position, the latch surface 34 of the lid is radially completely disengaged from the latch surface 32 of the frame and thus enables the lid 6 to tilt in the opening direction.

As shown in FIG. 2, the two resilient arms 40 extend in opposite circumferential directions. In addition, since they are offset from each other by approximately 120°, the two arms 40 thus form ergonomic means for gripping the lid 6 with a view to removing it from the frame or transporting it.

Furthermore, the lid 6 comprises means 46 for limiting the displacement of the free end 44, and therefore of the latch surface 34, in the direction of displacement towards the unlatched position. Thus, the arms 40 cannot be deformed excessively.

The fixed frame 4 and the lid 6 also have a stop 50 suitable for limiting the displacement of the lid 6 within the frame in the frame plane P—P. The stop 50 is also suitable for opposing a translation of the lid 6 in the direction of the central axis X—X when the lid is in the closed position on the frame.

To that end, the stop 50 comprises a stop surface 52 located on a projection 54 of each articulation lug 22. When the lid is latched on the frame, this stop surface 52 cooperates with a complementary stop surface 56 located in each recess 18 of the frame 4. The two stop surfaces 52, 56 are inclined relative to the frame plane P—P by an angle $\gamma$ which is approximately from 30° to 80°.

It will therefore be appreciated that, in the closed position of the lid on the frame, the normals to the stop surfaces 56 and to the latch surfaces 32 of the frame 4 are directed towards the central axis X—X while the normals to the latch surfaces 34 and to the stop surfaces 52 of the lid 6 are directed away from the central axis X—X.

In the latched position of the lid on the frame, the stop surfaces 52 and the latch surfaces 34 of the lid 6 are simultaneously in contact with the corresponding stop surfaces 56 and latch surfaces 32 of the frame 4.

Preferably, the dimensions of the lid 6 and of the frame 4 are such that the resilient arms 40 resiliently urge the latch surfaces 34 of the lid against the corresponding latch surfaces 32 of the frame, and also the stop surfaces 52 of the lid against the corresponding stop surfaces 56 of the frame.

The contact between the stop surfaces 52, 56 thus generates a reaction of support which is perpendicular to those inclined surfaces and which opposes the two normal reactions caused by the contact of the two latch surfaces 34 of the lid with the corresponding latch surfaces 32 of the frame.

An equilibrium of forces is thus reached at three points, namely at the two latches 30 and, opposite, at the hinge by way of the stop 50, which ensures that the lid 6 is stable not only in the frame plane P—P but also in the direction of the central axis X—X. The equilibrium of the horizontal components of the reactions of support at the two latches 30 and the stop 50 enables the lid 6 to maintain its position in the frame plane, for example if a vehicle brakes on the upper face of the lid 6, while the components in the direction of the central axis X—X of those reactions enable the lid 6 to be maintained flat on the frame 4 and thereby ensure its vertical stability.

Furthermore, the manhole cover 2 comprises clip-in surfaces 60, 62 (FIGS. 1, 3B, 3C and 4) which are located, on the one hand, on each of the resilient arms 40 and, on the other hand, on the frame 4 and which are suitable for cooperating with each other in such a manner as to bring each arm 40 automatically, by resilient deformation, into its latching position when the lid is closed. For that purpose, the clip-in surfaces 60, 62 have a common inclination greater than 0° and less than or equal to 45° relative to the central axis X—X, thus forming cams active in the closing direction of the lid.

It will also be appreciated that, in a manner known per se from patent EP 0 391 825, the base of the articulation housing of the frame is provided with an opening 64 (FIG. 1) permitting passage of the articulation lugs 22 of the lid when the lid is in a position open at 90° relative to its closed position, thus enabling the lid to be secured in this position open at 90° in order to prevent it from being closed prematurely, when, for example, the manhole cover is inspected by an operator.

By placing a jumper bar beneath the operating member 26 and by tilting the jumper bar outwards while bearing on the outer edge of the recess 28 of the frame, first the two latches 30 are unlatched, without acting directly on the resilient arms 40, which thus prevents any damage to or destruction of the resilient arms 40 which could result from excessive deformation in the case of direct action thereon. It is then necessary only to insert an appropriate tool into the operating member 26 and to cause the lid 6 to pivot in the opening direction in order to open it completely.

The invention claimed is:

1. A closure device comprising a fixed frame and a covering element supported by the frame, the frame defining a frame plane and a central axis perpendicular to said frame plane, the covering element being articulated to the frame by a hinge, the device comprising a first latch provided with a first covering element latch surface which is fixedly joined to the covering element and with a first frame latch surface which is fixedly joined to the frame, said first covering element and first frame latch surfaces being inclined relative to the frame plane and cooperating when the covering element is in the closed position on the frame, the covering element and the frame having a stop which is offset circumferentially from the first latch relative to the central axis, the stop comprising a stop surface which is fixedly joined to the covering element and a stop surface which is fixedly joined to the frame, these stop surfaces cooperating exclusively when the covering element is in the closed position and limiting a displacement of the covering element within the frame in the frame plane, wherein the stop surfaces of the covering element and the frame are inclined relative to the frame plane by an angle of from 30° to 80° and they maintain the covering element flat on the frame, and wherein the frame delimits an access opening which is closable by said covering element, and the frame plane extends parallel to said access opening.

2. A closure device according to claim 1, wherein the device comprises a second latch provided with a second covering element latch surface which is fixedly joined to the covering element and with a second frame latch surface which is fixedly joined to the frame, said second covering element and second frame latch surfaces being inclined relative to the frame plane and cooperating when the covering element is in the closed position on the frame, the first latch being offset circumferentially from the second latch and the stop relative to the central axis.

3. A closure device according to claim 1, wherein each latch is offset circumferentially from the stop relative to the central axis by at least 90°.

4. A closure device according to claim 2, wherein each latch is offset circumferentially from the stop relative to the central axis by at least 90°.

5. A closure device according to claim 1, wherein each latch comprises a resilient member provided with one of the latch surfaces, and wherein the resilient member enables the associated latch surface to be displaced between positions of latching the covering element in the frame and unlatching the covering element.

6. A closure device according to claim 2, wherein each latch comprises a resilient member provided with one of the latch surfaces, and wherein the resilient member enables the associated latch surface to be displaced between positions of latching the covering element in the frame and unlatching the covering element.

7. A closure device according to claim 3, wherein each latch comprises a resilient member provided with one of the latch surfaces, and wherein the resilient member enables the associated latch surface to be displaced between positions of latching the covering element in the frame and unlatching the covering element.

8. A closure device according to claim 4, wherein each latch comprises a resilient member provided with one of the latch surfaces, and wherein the resilient member enables the associated latch surface to be displaced between positions of latching the covering element in the frame and unlatching the covering element.

9. A closure device according to claim 5, wherein each resilient member urges, when the covering element is in the closed position, the latch surface of the covering element against the corresponding latch surface of the frame and the stop surface of the covering element against the corresponding stop surface of the frame.

10. A closure device according to claim 5, wherein the resilient member is a circumferential resilient arm, the associated latch surface being located on a free end of that arm, the other end of that arm being secured to the covering element.

11. A closure device according to claim 9, wherein the resilient member is a circumferential resilient arm, the associated latch surface being located on a free end of that arm, the other end of that arm being secured to the covering element.

12. A closure device according to claim 5, wherein the device comprises a second latch provided with a second covering element latch surface which is fixedly joined to the covering element and with a second frame latch surface which is fixedly joined to the frame, said second covering element and second frame latch surfaces being inclined relative to the frame plane and cooperating when the covering element is in the closed position on the frame, the first latch being offset circumferentially from the second latch and the stop relative to the central axis, wherein each resilient member is a circumferential resilient arm, the associated latch surface being located on a free end of that arm, the other end of that arm being secured to the covering element, and wherein the resilient arms extend in opposite circumferential directions.

13. A closure device according to claim 5, and comprising means for limiting the displacement of the latch surface located on the resilient member, this being effected in the direction of displacement towards the position of unlatching the covering element.

14. A closure device according to claim 1, wherein the hinge comprises a frame knuckle and a covering element knuckle, and in that the stop is formed by at least one projection which is fixedly joined to the knuckle of the covering element and a cooperating surface fixedly joined to the frame knuckle.

15. The closure device according to claim 1, wherein the closure device is a manhole cover.

16. A manhole cover comprising a fixed frame and a covering element supported by the frame, the frame defining a frame plane and a central axis perpendicular to said frame plane, the covering element being articulated to the frame by a hinge, the device comprising a first latch provided with a first covering element latch surface which is fixedly joined to the covering element and with a first frame latch surface which is fixedly joined to the frame, said first covering element and first frame latch surfaces being inclined relative to the frame plane and cooperating when the covering element is in the closed position on the frame, the covering element and the frame having a stop which is offset circumferentially from the first latch relative to the central axis, the stop comprising a stop surface which is fixedly joined to the covering element and a stop surface which is fixedly joined to the frame, these stop surfaces cooperating exclusively when the covering element is in the closed position and limiting a displacement of the covering element within the frame in the frame plane, wherein the stop surfaces of the covering element and the frame are inclined relative to the frame plane by an angle of from 30° to 80° and they maintain the covering element flat on the frame, and wherein the frame delimits an access opening which is closable by said covering element, and the frame plane extends parallel to said access opening.

* * * * *